US008240068B1

(12) United States Patent
Baker

(10) Patent No.: US 8,240,068 B1
(45) Date of Patent: Aug. 14, 2012

(54) ACCESSORY FOR PROTECTING BOOTS FROM WEAR AND TEAR

(76) Inventor: Delbert E. Baker, Willows, CA (US)

( * ) Notice: Subject to any disclaimer, the term of this patent is extended or adjusted under 35 U.S.C. 154(b) by 451 days.

(21) Appl. No.: 12/508,411

(22) Filed: Jul. 23, 2009

(51) Int. Cl.
*A43B 5/00* (2006.01)

(52) U.S. Cl. ..... 36/131; 36/136; 36/72 R

(58) Field of Classification Search ..... 36/131, 36/136, 72 R, 77 R, 71.5, 73, 74, 127, 1
See application file for complete search history.

(56) References Cited

U.S. PATENT DOCUMENTS

| | | | | | |
|---|---|---|---|---|---|
| 2,179,942 | A | * | 11/1939 | Lyne | 36/127 |
| 2,485,706 | A | * | 10/1949 | Cruise | 36/73 |
| 3,403,461 | A | * | 10/1968 | McCarney | 36/67 D |
| 3,812,606 | A | | 5/1974 | Merola | |
| 4,335,529 | A | * | 6/1982 | Badalamenti | 36/59 R |
| 4,484,397 | A | * | 11/1984 | Curley, Jr. | 36/92 |
| 4,712,317 | A | * | 12/1987 | Sowell | 36/133 |
| D303,037 | S | | 8/1989 | Kushitani | |
| D316,926 | S | * | 5/1991 | St. John | D2/962 |
| 5,168,644 | A | | 12/1992 | Ellis | |
| 5,855,078 | A | | 1/1999 | Starker | |
| 5,873,185 | A | | 2/1999 | Harris et al. | |
| 5,875,569 | A | * | 3/1999 | Dupree | 36/103 |
| 6,286,234 | B1 | | 9/2001 | Smith, Jr. | |
| D482,514 | S | | 11/2003 | Whittington | |
| 6,981,340 | B2 | | 1/2006 | Evans | |
| RE40,215 | E | * | 4/2008 | Cummings et al. | 36/142 |
| 2005/0246923 | A1 | | 11/2005 | Bergamin | |

* cited by examiner

*Primary Examiner* — Ted Kavanaugh

(57) ABSTRACT

A boot accessory for attaching to a side of a boot comprising an elongated bar having an outer face and an inner face; wherein a first indentation is disposed in the outer face at a first end of the bar and a second indentation is disposed in the outer face at a second end of the bar; wherein the inner face is attached to the side of the boot such that the outer face extends outwardly from the boot; wherein a first screw is driven from the first indentation through the bar and into the side of the boot and a second screw is driven from the second indentation though the bar and into the side of the boot.

6 Claims, 3 Drawing Sheets

ACCESSORY FOR PROTECTING BOOTS FROM WEAR AND TEAR

FIELD OF THE INVENTION

The present invention is directed to a boot accessory, more particularly to an accessory that attaches to the side of a boot's sole that protects the boot from wear and tear.

BACKGROUND OF THE INVENTION

Shifting gears of a motorcycle is often done with one's feet. With time, the motorcyclist's boots become damaged from repeated shifting. The present invention features a boot accessory that can be attached to the side of boots as well as a method of protecting a boot with a boot accessory. The boot accessory can help protect one's boots from the wear and tear that is often caused by shifting gears of a motorcycle.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
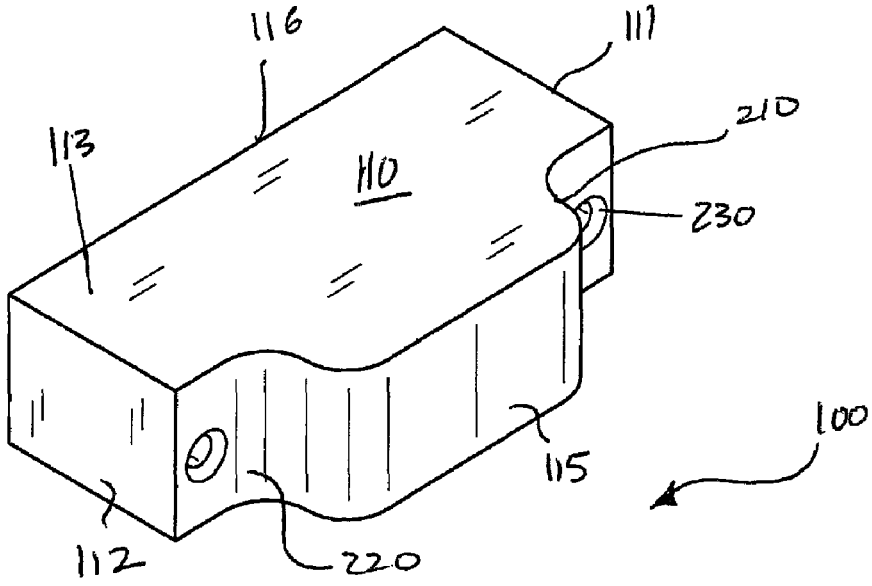
FIG. 1 is a first perspective view of the boot accessory of the present invention.
Figure 2:
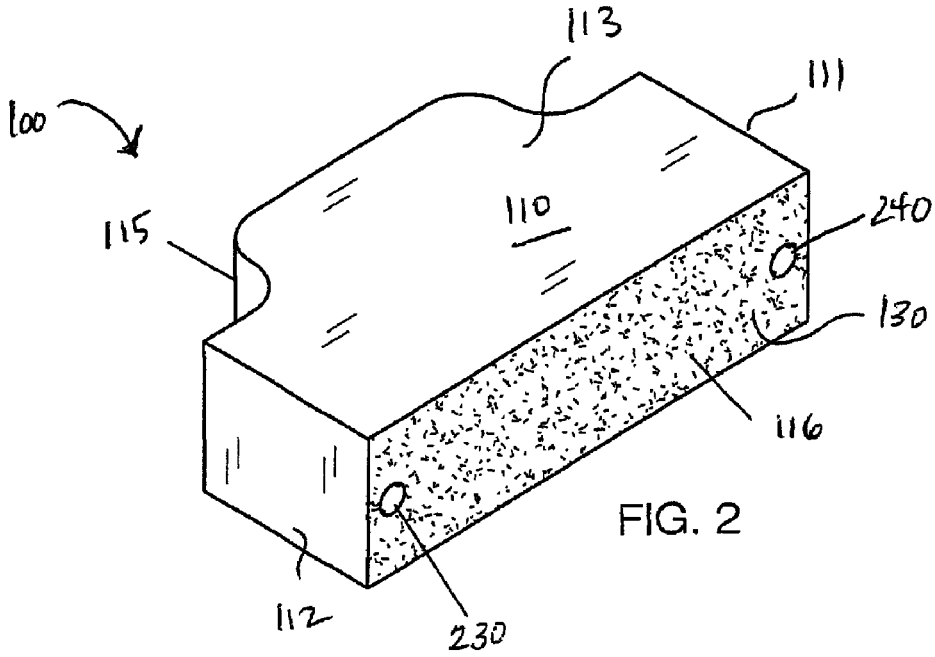
FIG. 2 is a second perspective view of the boot accessory of FIG. 1.
Figure 3:
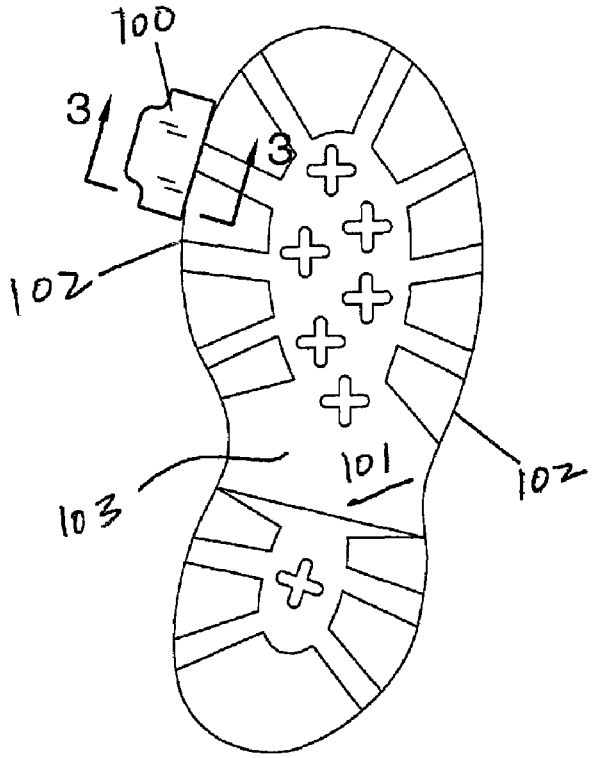
FIG. 3 is a bottom view of the boot accessory of FIG. 1.
Figure 4:
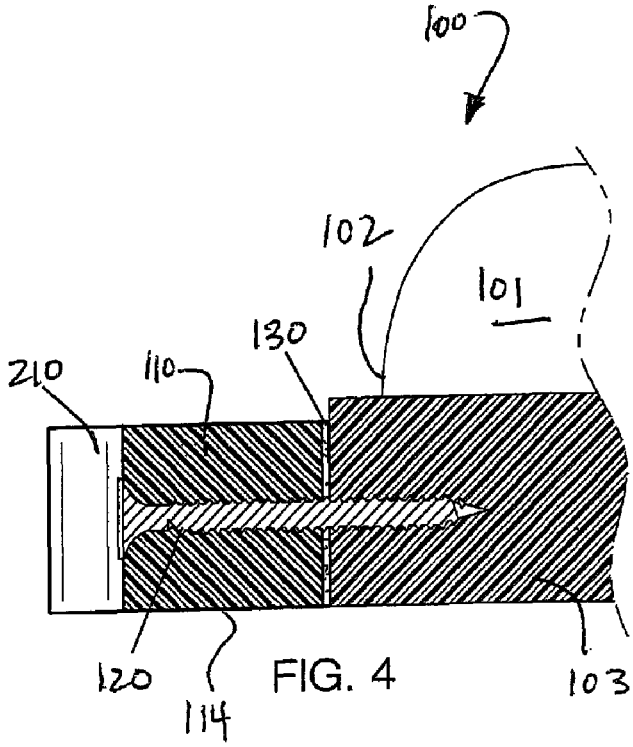
FIG. 4 is a cross sectional view of the boot accessory of FIG. 1.
Figure 5:
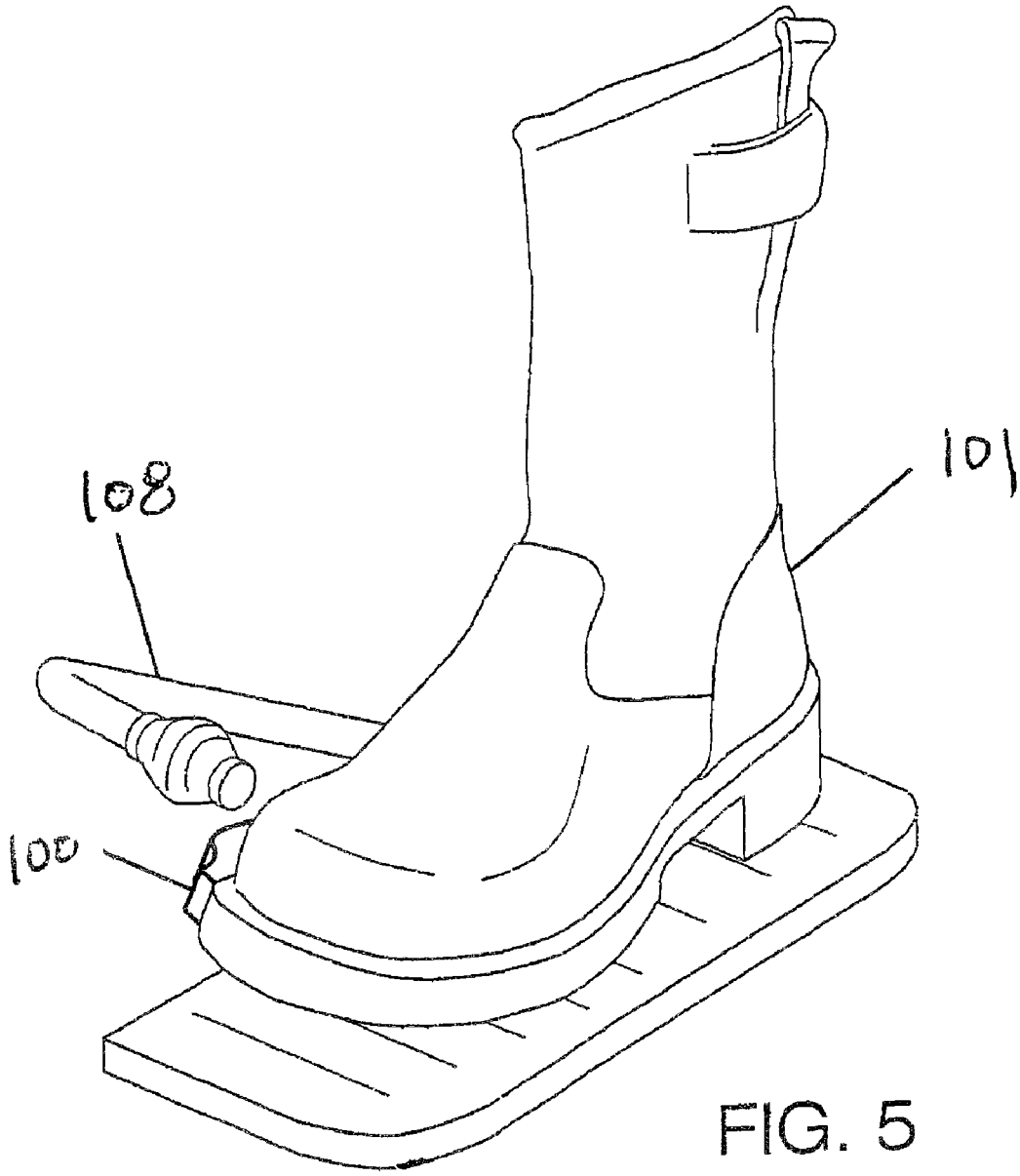
FIG. 5 is a perspective view of the boot accessory of FIG. 1, wherein the accessory is shown attached to a boot.

The following is a listing of numbers corresponding to a particular element refer to herein:

100 boot accessory
101 boot
102 side of boot
103 sole of boot
108 gear shifter of motorcycle
110 elongated bar
111 first side of elongated bar
112 second side of elongated bar
113 top surface of elongated bar
114 bottom surface of elongated bar
115 outer face of elongated bar
116 inner face of elongated bar
120 screw
130 adhesive
210 first indentation
220 second indentation
230 first aperture
240 second aperture Referring now to FIGS. 1-5, the present invention features a boot accessory 100 that helps protect a boot 101 from wear and tear (e.g., wear and tear associated with shifting gears of a motorcycle). The boot accessory 100 can be attached to a side 102 (e.g., right side, left side) of a boot 101 (e.g., right boot, left boot) and extend outwardly from the boot 101. Generally for motorcycle purposes, the boot accessory 100 is attached to the right side of a left boot. The boot accessory 100 can allow a user (e.g., motorcyclist) to shift gears without the gear shifter 108 marring or destroying the top of his/her boot.

The boot accessory comprises an elongated bar 110 having a first end 111, a second end 112, a top flat surface 113, a bottom flat surface 114, an outer face 115, and an inner face 116. The top flat surface is parallel to the bottom flat surface. The bar 110 may be constructed from a variety of materials. For example, in some embodiments, the bar 110 is constructed from a rubber, particularly a durable rubber.

In some embodiments, a first indentation 210 is disposed in the outer face 115 of the bar 110 at the first end 111. In some embodiments, a second indentation 220 is disposed in the outer face 115 of the bar 110 at the second end 112. The first indentation forms a first arm-pit of the T-shape, and the second indentation forms a second arm-pit of the T-shape. The stem of the T-shape is in the same plane as the cross-bar of the T-shape;

Traversing the width of the bar 110 (e.g., laterally) from the first indentation 210 to the inner face 116 of the bar 110 is a first aperture 230. Traversing the width of the bar 110 (e.g., laterally) from the second indentation to the inner face 116 of the bar 110 is a second aperture 240. The apertures are both adapted for receiving a screw 120.

A screw 120 can be driven through the first aperture 230 such that it extends out of the inner face 116 of the bar 110. A screw 120 can be driven through the second aperture 240 such that it extends out of the inner face 116 of the bar 110. The screw 120 can be further driven through the side 102 of the boot 101 (e.g., the sole 103 of the boot 101). The screw 120 provides a strong and secure connection to the boot 101. This is particularly important for motorcyclists when shifting gears with the boot accessory 100.

In some embodiments, the inner face 116 of the bar 110 or a portion of the inner face 116 is coated with an adhesive 130. The adhesive 130 may provide additional strength and security when attaching the bar 110 to the side 102 (e.g., sole 103) of the boot 101.

The bar 110 should be sized sufficiently to allow the user to use the bar 110 for shifting gears of his/her motorcycle. In some embodiments, the bar 110 is between about 0.5 to 1.0 inches in width as measured from the outer face 115 to the inner face 116. In some embodiments, the bar 110 is between about 1.0 to 1.5 inches in width as measured from the outer face 115 to the inner face 116. In some embodiments, the bar 110 is more than about 1.5 inches in width.

In some embodiments, the bar 110 is between about 1.0 to 1.5 inches in length as measured from the first end 111 to the second end 112. In some embodiments, the bar 110 is between about 1.5 to 2.0 inches in length as measured from the first end 111 to the second end 112. In some embodiments, the bar 110 is more than about 2.0 inches in length.

In some embodiments, the bar 110 is between about 0.25 to 0.5 inches in height as measured from the top surface 113 to the bottom surface 114. In some embodiments, the bar 110 is between about 0.5 to 07.5 inches in height as measured from the top surface 113 to the bottom surface 114. In some embodiments, the bar 110 is more than about 0.75 inches in height.

In some embodiments, the boot accessory 100 is attached to boots after the boots are manufactured. In some embodiments, the boot accessory 100 is incorporated into boots during the manufacturing process.

The present invention also features a method of protecting a boot 101 comprising attaching a boot accessory 100 to a side

102 of the boot 101. The boot accessory 100 comprises an elongated bar 110 having an outer face 115 and an inner face 116. A first indentation 210 is disposed in the outer face 115 at a first end 111 of the bar 110, and a second indentation 220 is disposed in the outer face 115 at a second end 112 of the bar 110. The inner face 116 is attached to the side 102 of the boot 101 such that the outer face 115 extends outwardly from the boot 101. In some embodiments, a first screw 120 is driven from the first indentation 210 through the bar 110 and into the side 102 of the boot 101 (e.g., via a first aperture 230). In some embodiments, a second screw 120 is driven from the second indentation 220 though the bar 110 and into the side of the boot 101 (e.g., via a second aperture 240).

The following the disclosures of the following U.S. Patents are incorporated in their entirety by reference herein: U.S. Pat. No. 6,981,340; U.S. Pat. No. 6,286,234; U.S. Pat. No. 5,873,185; U.S. Pat. No. 5,855,078; U.S. Pat. No. 5,168,644; U.S. Pat. No. 3,812,606.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A boot accessory having a single T-shape with a stem and a crossbar, for attaching to a side of a boot, said boot accessory comprising an elongated bar having an outer face, an inner face, a top flat surface and a bottom flat surface;

wherein the top flat surface is parallel to the bottom flat surface, wherein a first indentation is disposed in the outer face at a first end of the bar, and a second indentation is disposed in the outer face at a second end of the bar, the first indentation forms a first arm-pit of the T-shape, the second indentation forms a second arm-pit of the T-shape;

wherein the stem of the T-shape is in the same plane as the cross-bar of the T-shape;

wherein the inner face is attachable to the side of the boot such that the outer face extends outwardly from the boot;

wherein a first screw is driven from the first indentation through the bar and into the side of the boot and a second screw is driven from the second indentation though the bar and into the side of the boot.

2. The boot accessory of claim 1, wherein the boot accessory is for protecting the boot from wear associated with shifting gears of a motorcycle.

3. The boot accessory of claim 1, wherein the bar is constructed from a material comprising a durable rubber.

4. The boot accessory of claim 1, wherein the side of the boot includes the right side and the left side.

5. The boot accessory of claim 1, wherein a portion of the inner face of the bar is coated with an adhesive for further securing the bar to the boot.

6. The boot accessory of claim 1, wherein the bar is sized sufficiently to allow the bar to be used for shifting gears of a motorcycle.

* * * * *